US010150605B2

(12) United States Patent
Motai et al.

(10) Patent No.: US 10,150,605 B2
(45) Date of Patent: Dec. 11, 2018

(54) CHEMICAL STORAGE CONTAINER, CHEMICAL STORAGE STRUCTURE, AND METHOD OF DISCHARGING LIQUID CHEMICAL

(71) Applicant: DAI NIPPON PRINTING CO., LTD., Tokyo-to (JP)

(72) Inventors: Katsuyuki Motai, Tokyo-to (JP); Masato Miyake, Tokyo-to (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 464 days.

(21) Appl. No.: 14/772,185

(22) PCT Filed: Mar. 6, 2014

(86) PCT No.: PCT/JP2014/055788
§ 371 (c)(1),
(2) Date: Sep. 2, 2015

(87) PCT Pub. No.: WO2014/136880
PCT Pub. Date: Sep. 12, 2014

(65) Prior Publication Data

US 2016/0009472 A1 Jan. 14, 2016

(30) Foreign Application Priority Data

Mar. 7, 2013 (JP) ..... 2013-045771

(51) Int. Cl.
*B65D 25/40* (2006.01)
*B65D 77/06* (2006.01)
(Continued)

(52) U.S. Cl.
CPC ..... *B65D 77/06* (2013.01); *B65D 81/2046* (2013.01); *B65D 83/0055* (2013.01);
(Continued)

(58) Field of Classification Search
CPC ..... B65D 77/06; B65D 81/2046; B65D 83/0055; B65D 83/32; B65D 83/40; B65D 83/62; B65D 83/756; B65D 85/84
(Continued)

(56) References Cited

U.S. PATENT DOCUMENTS 5,350,080 A * 9/1994 Brown ..... B67D 7/0288 215/247
5,435,460 A 7/1995 Osgar
(Continued)

FOREIGN PATENT DOCUMENTS

CN 102448851 A 5/2012
EP 0 013 565 A1 7/1980
(Continued)

OTHER PUBLICATIONS

Oct. 8, 2016 First Notification of Reasons for Rejection issued in Chinese Application No. 201480007490.6.
(Continued)

*Primary Examiner* — J. Gregory Pickett
*Assistant Examiner* — Niki M Eloshway
(74) *Attorney, Agent, or Firm* — Oliff PLC

(57) ABSTRACT

A chemical storage container enables easy installation of a chemical nozzle and a pressurized gas supply nozzle. The chemical storage container includes a metal can having a top opening, a chemical storage bag disposed in the metal can and an ejection member mounted to the chemical storage bag. The top opening of the metal can is closed by a lid to which a chemical nozzle and a pressurized gas supply nozzle are mounted. The chemical nozzle penetrates through the ejection member. A pressurized gas from the pressurized gas supply nozzle is supplied through the ejection member into a pressurization space formed between the metal can and the chemical storage bag.

10 Claims, 5 Drawing Sheets

(51) Int. Cl.

| | |
|---|---|
| ***B65D 83/00*** | (2006.01) |
| ***B65D 85/84*** | (2006.01) |
| ***B65D 81/20*** | (2006.01) |
| ***B65D 83/40*** | (2006.01) |
| ***B65D 83/62*** | (2006.01) |
| ***B65D 83/14*** | (2006.01) |
| ***B65D 83/32*** | (2006.01) |
| *B65D 25/18* | (2006.01) |

(52) U.S. Cl.
CPC ..... *B65D 83/32* (2013.01); *B65D 83/40* (2013.01); *B65D 83/62* (2013.01); *B65D 83/756* (2013.01); *B65D 85/84* (2013.01)

(58) Field of Classification Search
USPC ..... 220/495.05, 327, 328, 582
See application file for complete search history.

(56) References Cited

U.S. PATENT DOCUMENTS

| | | | | |
|---|---|---|---|---|
| 5,582,799 | A * | 12/1996 | Amorese | B01J 3/03 220/327 |
| 6,375,046 | B1 * | 4/2002 | Alleard | B65D 83/425 141/20 |
| 2005/0161523 | A1 * | 7/2005 | Sakaida | B05B 7/0012 239/8 |
| 2009/0020176 | A1 | 1/2009 | Hasegawa et al. | |
| 2009/0184133 | A1 | 7/2009 | Hasegawa et al. | |
| 2009/0212071 | A1 * | 8/2009 | Tom | B65B 31/003 222/95 |
| 2009/0230132 | A1 * | 9/2009 | Takedutsumi | B65D 77/06 220/495.06 |
| 2011/0210148 | A1 | 9/2011 | Nelson et al. | |
| 2012/0187153 | A1 | 7/2012 | Burge et al. | |
| 2014/0008389 | A1 * | 1/2014 | Mekata | B65D 83/20 222/94 |
| 2014/0117043 | A1 * | 5/2014 | Ware | B65D 85/84 222/95 |
| 2015/0344214 | A1 * | 12/2015 | Yamaguchi | B65D 83/38 222/95 |
| 2016/0009472 | A1 * | 1/2016 | Motai | B65D 77/06 220/495.05 |
| 2016/0176615 | A1 * | 6/2016 | Harada | B65D 83/0055 222/95 |

FOREIGN PATENT DOCUMENTS

| | | | |
|---|---|---|---|
| GB | 2465234 | A | 5/2010 |
| JP | H09-183467 | A | 7/1997 |
| JP | H10-000436 | A | 1/1998 |
| TW | 200824987 | A | 6/2008 |
| TW | 200841381 | A | 10/2008 |
| TW | 201221125 | A | 6/2012 |
| WO | 2007/088661 | A1 | 8/2007 |
| WO | 2008/101275 | A1 | 8/2008 |
| WO | 2010/137424 | A1 | 12/2010 |
| WO | 2012/071376 | A2 | 5/2012 |

OTHER PUBLICATIONS

Apr. 25, 2017 Office Action issued in Taiwanese Patent Application No. 103107894.
Sep. 17, 2015 International Preliminary Report on Patentability issued in International Patent Application No. PCT/JP2014/055788.
May 27, 2014 International Search Report issued in International Patent Application No. PCT/JP2014/055788.

* cited by examiner

CHEMICAL STORAGE CONTAINER, CHEMICAL STORAGE STRUCTURE, AND METHOD OF DISCHARGING LIQUID CHEMICAL

TECHNICAL FIELD

The present disclosure relates to a chemical storage container, and particularly relates to a chemical storage container for storing a liquid chemical such as a lithium-ion battery electrolyte.

BACKGROUND ART

A liquid chemical such as a lithium-ion battery electrolyte is generally stored and transported in a canister (metal can). The liquid chemical is taken from the metal can and used as necessary.

The interior of the metal can, from which the liquid chemical has been taken, is cleaned. A new liquid chemical is put into the cleaned metal can, and the metal can is transported.

A lithium-ion battery electrolyte needs to be handled carefully: For example, cleaning of a metal can, which has once stored a lithium-ion battery electrolyte, needs to be performed with high accuracy. This requires a high cost for the cleaning of the metal can.

For cleaning of a canister, it is necessary to plan a cleaning process so that in addition to the removal of the contents, no residues will remain in the canister after cleaning (patent document 1).

PRIOR ART DOCUMENT

Patent Document

Patent document 1: Japanese Patent Laid-Open Publication No. H10-000436

As described above, when a liquid chemical such as a lithium-ion battery electrolyte is stored in a metal can, the interior of the metal can needs to be cleansed every time the liquid chemical is taken out. Thus, a high cost is required for the cleaning.

A chemical storage container has been developed which includes a metal can, a chemical storage bag disposed in the metal can, and a chemical nozzle which penetrates through the metal can and the chemical storage bag. A liquid chemical is discharged from the chemical storage bag via the chemical nozzle. In particular, pressurized $N_2$ gas is supplied from an $N_2$ gas supply nozzle to a space between the metal can and the chemical storage bag so that the liquid chemical in the chemical storage bag is discharged to the outside by the pressurized gas. The chemical nozzle and the $N_2$ gas supply nozzle are held by an ejection member provided in the metal can and the chemical storage bag.

However, it is not easy to mount the ejection member to the metal can and the chemical bag in a tightly closed state and, in addition, to mount the chemical nozzle and the $N_2$ gas supply nozzle to the ejection member.

The present invention has been made in view of the above situation. One object of the present invention is to provide a chemical storage container which has a simple structure and which enables a chemical nozzle and a pressurized gas supply nozzle to be easily mounted to a metal can and a chemical storage bag.

Means for Solving the Problems

According to some embodiments, a chemical storage container for storing a liquid chemical comprises: an outer can having a top opening; and a chemical storage bag for storing a liquid chemical, disposed in the outer can and having an ejection member mounted to the upper end, wherein the ejection member is provided in the top opening of the outer can, wherein a lid which closes the top opening of the outer can is provided such that it covers the ejection member, and wherein a chemical nozzle for discharging the liquid chemical and which penetrates through the ejection member, and a pressurized gas supply nozzle for supplying a pressurized gas into the ejection member are mounted to the lid.

DETAILED DESCRIPTION

Embodiments

Some embodiments will now be described with reference to the drawings. Exemplary embodiments of the present invention are described herein. It should be noted that these exemplary embodiments are merely examples and the present invention is not limited to the detailed embodiments.

FIGS. 1 through 5A, 5B are diagrams showing an embodiment of a chemical storage container in accordance with an embodiment.

Figure 1:
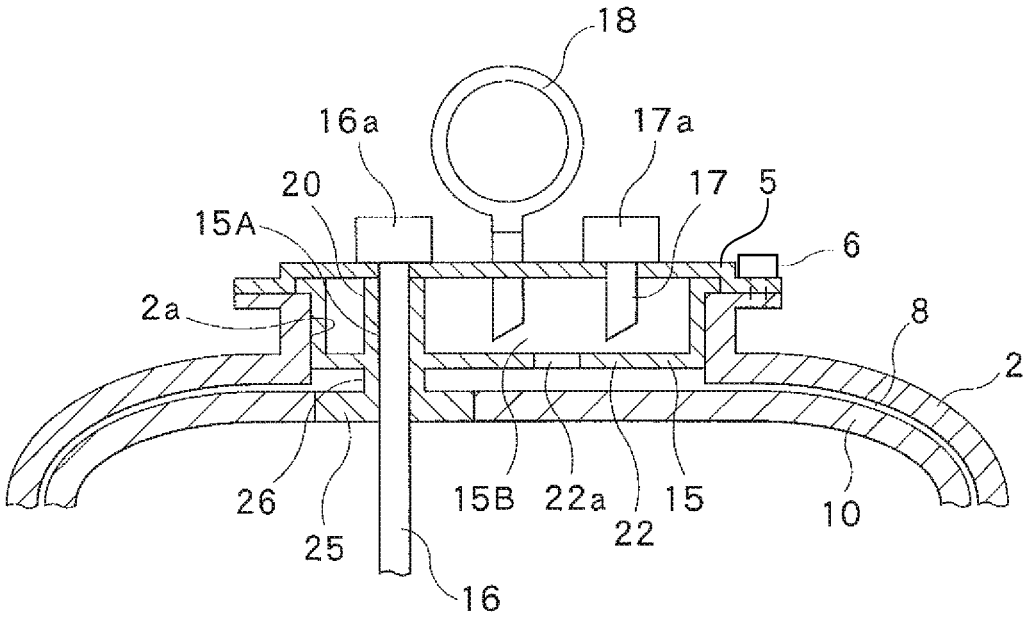
FIG. 1 is an enlarged view of an ejection member portion of a chemical storage container in accordance with an embodiment.
Figure 2:
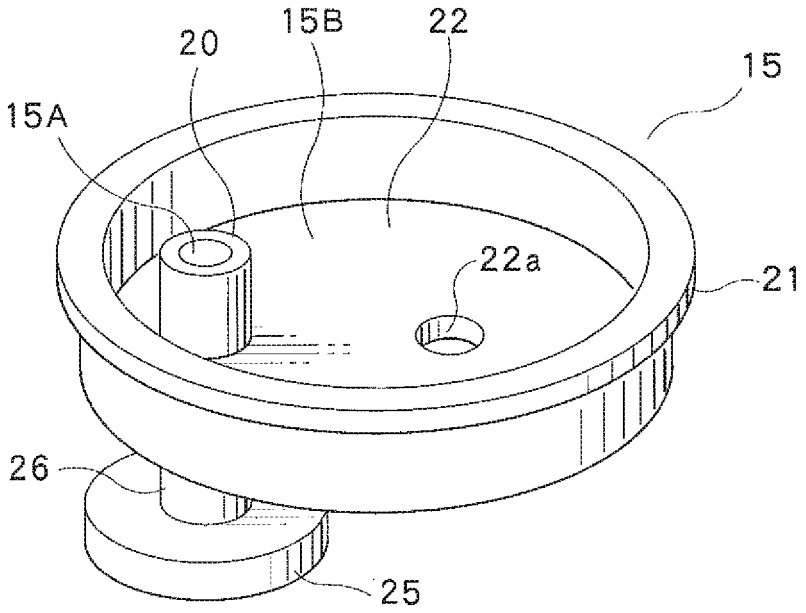
FIG. 2 is a perspective view of the ejection member of the chemical storage container.
Figure 3:
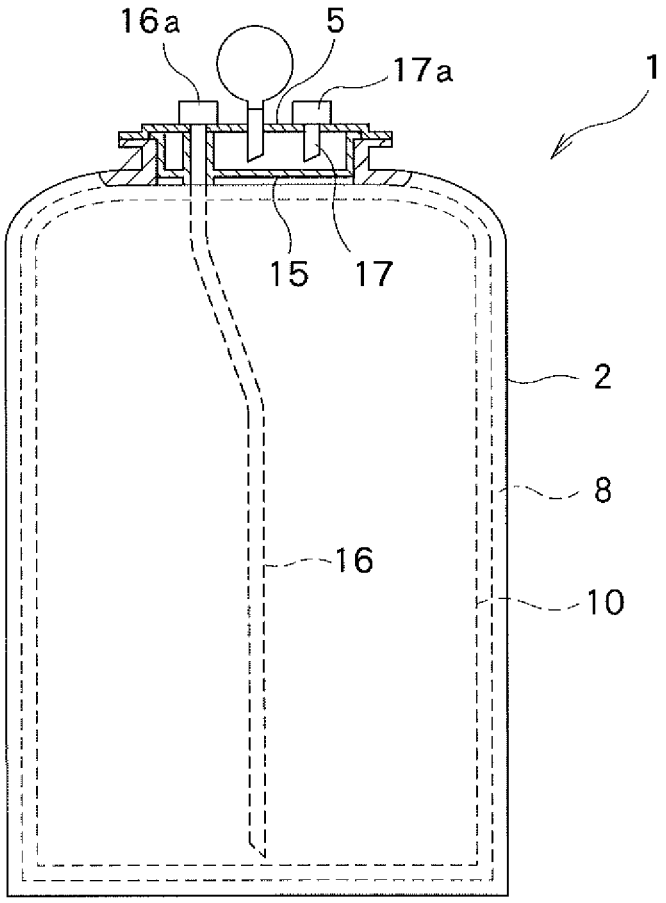
FIG. 3 is an overall schematic view of the chemical storage container.

First, the chemical storage container will be outlined with reference to FIGS. 1 through 3.

As shown in FIGS. 1 through 3, the chemical storage container 1 includes a chemical storage bag 10 for storing a liquid chemical such as a lithium-ion battery electrolyte, and an outer can 2 made of a metal (hereinafter also referred to as the metal can). Besides a metal, the outer can 2 may be made of a synthetic resin.

Besides a lithium-ion battery electrolyte, the chemical storage bag 10 can store other liquid chemicals, for example, a liquid chemical for resist removal, a liquid chemical for etching or other liquid chemicals for use in a semiconductor manufacturing process.

Further, the chemical storage bag 10 may store: a liquid chemical for resist removal or an etching liquid for use in a lead frame manufacturing process; a liquid chemical for resist removal or an etching liquid for use in a suspension substrate manufacturing process; or a printing ink for use in a printing process.

A Li ion-containing organic electrolyte, e.g. containing $LiClO_4$ or $LiPF_6$, can be used as a lithium-ion battery electrolyte to be stored in the chemical storage bag 10.

Such an organic electrolyte does not match moisture, halogens, metal ions, etc. Therefore, a material containing little moisture, halogens, metal ions, etc. is preferably used for an inner bag 11 which stores such an organic electrolyte.

The metal can 2 has a top opening 2*a* on the upper side which is closed by a lid 5. The metal can 2 and the lid 5 are made of stainless steel.

Figure 4:
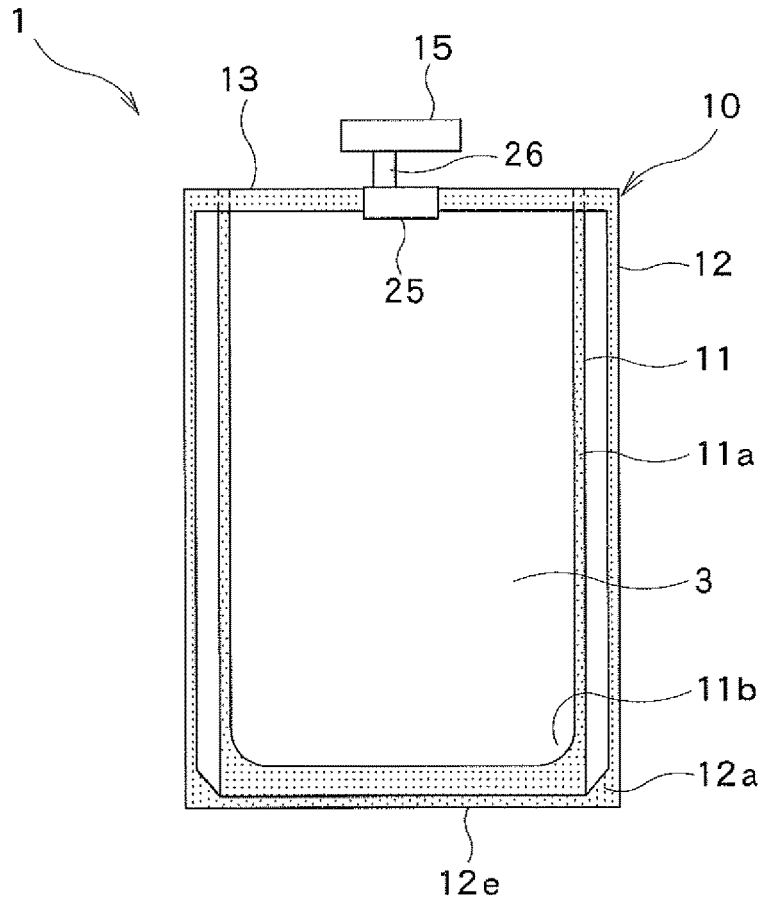
FIG. 4 is a side view of the chemical storage container and the ejection member.

As shown in FIG. 4, the chemical storage bag 10 includes the inner bag 11 for storing a liquid chemical 3 such as a lithium-ion battery electrolyte, and an outer bag 12 that surrounds the inner bag 11. An ejection member 15 is mounted to the upper end of the chemical storage bag 10, and penetrates through the upper end of the inner bag 11 and the outer bag 12.

The installation structure of the ejection member 15 and the lid 5 will now be described with reference to FIGS. 1 through 3.

As shown in FIGS. 1 through 3, the ejection member 15 is fit into the top opening 2*a* of the metal can 2, while the lid 5 covers the ejection member 15 and closes the top opening 2*a* of the metal can 2, and is fixed by bolts 6 to a portion of the metal can 2, located around the top opening 2*a*.

The ejection member 15 will be described further. The ejection member 15, at its upper end, has a peripheral flange 21. The ejection member 15 is positioned with respect to the top opening 2*a* of the metal can 2 by fitting the peripheral flange 21 into the top opening 2*a*.

The ejection member 15 is provided with a cylindrical partition wall 20 which divides the interior of the ejection member 15 into a chemical nozzle space 15A through which the below-described chemical nozzle 16 penetrates, and a pressurized gas space 15B which is to be filled with a pressurized gas supplied from the below-described pressurized gas supply nozzle 17. Thus, the chemical nozzle space 15A, through which the chemical nozzle 16 extends, is formed inside the cylindrical partition wall 20 of the ejection member 15, while the pressurized gas space 15B is formed outside the cylindrical partition wall 20 of the ejection member 15.

The ejection member 15 has a bottom 22 in which a through-hole 22*a* is formed. The pressurized gas space 15B of the ejection member 15 communicates via the through-hole 22*a* with a pressurization space 8 formed between the metal can 2 and the chemical storage bag 10. The pressurization space 8 may extend from the upper side of the lower side of a clearance between the metal can 2 and the chemical storage bag 10. As seen in FIG. 1, for example, the pressurization space 8 may have a broader part forming a clearance between the ejection member 15 and the upper end of the chemical storage bag 10, and a narrower part forming a clearance between the metal can 2 and the chemical storage bag 10, the narrower part being narrower than the broader part.

The ejection member 15 has a coupling portion 26 which extends downward from the partition wall 20. The coupling portion 26, at its lower end, has a seal fixing portion 25 to which is fixed a sealed portion 13 where the inner bag 11 and the outer bag 12 are sealed integrally. The seal fixing portion 25 of the ejection member 15 has a generally elliptical shape in a plan view so that the sealed portion 13 of the chemical storage bag 10 can be easily fixed to the seal fixing portion 25.

As described above, the chemical nozzle 16 penetrates through the chemical nozzle space 15A of the ejection member 15, and a pressurized gas is supplied from the pressurized gas supply nozzle 17 into the pressurized gas space 15B.

As shown in FIGS. 1 through 3, the chemical nozzle 16 extends in the chemical nozzle space 15A of the ejection member 15, and is firmly held by the lid 5. The chemical nozzle 16 is provided to eject the liquid chemical 3 from the chemical storage bag 10. However, the chemical nozzle 16 may also be used to fill the liquid chemical 3 into the chemical storage bag 10.

The pressurized gas supply nozzle 17 is also firmly held by the lid 5, and can fill an inert gas, such as $N_2$ gas, into the pressurized gas space 15B of the ejection member 15. The inert gas which has been supplied from the pressurized gas supply nozzle 17 into the pressurized gas space 15B is fed through the through-hole 22*a* into the pressurization space 8 between the metal can 2 and the chemical storage bag 10. The chemical storage bag 10 can be externally pressurized by the inert gas supplied into the pressurization space 8, whereby the liquid chemical 3 in the chemical storage bag 10 can be discharged from the chemical nozzle 16.

A pressure gauge 18 for detecting the pressure in the pressurized gas space 15B is installed in the lid 5. A connecter 16*a* coupled to an external line (not shown) is provided at the front end of the chemical nozzle 16 mounted to the lid 5. Further, a connecter 17*a* coupled to an external line (not shown) is provided at the front end of the pressurized gas supply nozzle 17.

The above-described ejection member 15 as a whole is made of synthetic resin.

Figure 5A:
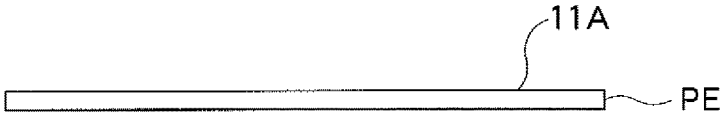
FIG. 5A is a cross-sectional view of a material for an inner bag.

The chemical storage bag 10 will now be described with reference to FIGS. 4 and 5. The inner bag 11, constituting the chemical storage bag 10, is obtained by preparing a pair of films composed of an inner bag material 11A, and heat-sealing the peripheries of the pair of films to form a heat-sealed portion 11*a* (see FIG. 5A).

A polyolefin material, such as polyethylene (PE) or polypropylene (PP), can be used as the inner bag material 11A. The inner bag 11 is to directly contact the liquid chemical 3. Therefore, a material containing little moisture, halogens and metal ions which a lithium-ion battery electrolyte dislikes, for example, a material having a low moisture content, a low halogen content and a low metal ion content, is preferably used as the inner bag material 11A. Further, an additive-free polyolefin material is preferably used as the inner bag material 11A. The use of an additive-free polyolefin material can prevent a component of the inner bag material 11A from dissolving in the liquid chemical 3.

The corner 11*b* of the inner bag 11 has a curved surface so that the inner bag 11 will not break even when pressure is applied from the liquid chemical 3 to the inner surface of the inner bag 11 during transport of the chemical storage container 1 holding the liquid chemical 3.

In particular, in the chemical storage container 1, the chemical storage bag 10, having the inner bag 11 in which the liquid chemical 3 is held, is disposed in the metal can 2. It is possible that during transport of the chemical storage container 1, pressure may be applied to the inner surface of the inner bag 11 from the liquid chemical 3 in the inner bag 11.

If the corner 11*b* of the inner surface of the inner bag 11 has a polygonal shape, a local stress will be generated in the polygonal corner 11*b* when pressure is applied from the liquid chemical 3 to the inner surface of the inner bag 11, which can result in breakage of the inner bag 11 in the vicinity of the corner 11*b*.

According to some embodiments, on the other hand, the corner 11*b* of the inner surface of the inner bag 11 has a curved shape. Therefore, even when pressure is applied from the liquid chemical 3 to the inner surface of the inner bag 11 during transport of the chemical storage container 1, no local stress will be generated in the curved corner 11*b*. This can prevent breakage of the inner bag 11 in the vicinity of the corner 11*b*.

The corner 11*b* of the inner bag 11 having a curved surface can be obtained by shaping the heat-sealed portion 11*a* such that the corner 11*b* has a curved surface.

The outer bag 12 will now be described further. The outer bag 12 surrounds the inner bag 11, is disposed in the metal can 2, and functions to externally protect the inner bag 11 so that an impact on the metal can 2 will not be directly transmitted to the inner bag 11.

Figure 5B:
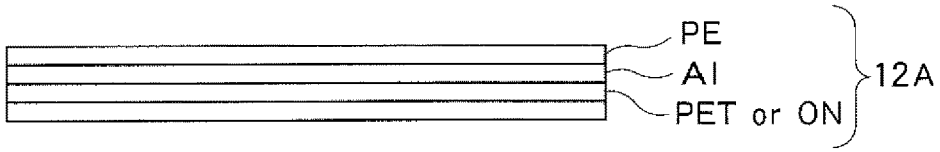
FIG. 5B is a cross-sectional view of a material for an outer bag.

Therefore, as an outer bag material 12A for the outer bag 12 may be used a laminate including a polyolefin layer such as PE or PP, an aluminum layer (Al layer), and a polyethylene terephthalate layer (PET layer) or an oriented nylon layer (ON layer), disposed in this order from the innermost layer (see FIG. 5B).

The polyolefin layer such as PE or PP functions as a heat-seal layer, the Al layer functions as a gas barrier layer, and the PET or ON layer has impact resistance.

Thus, the material 12A for the outer bag 12 has excellent impact resistance and gas barrier properties as compared to the material 11A for the inner bag 11, while the material 11A for the inner bag 11 has a low moisture content, a low halogen content and a low metal ion content as compared to the material 12A for the outer bag 12.

The outer bag 12 is obtained by preparing a front-surface film composed of the outer bag material 12A, a backside film and a pair of gusset films, and heat-sealing the peripheries of these films to form a heat-sealed portion 12*a*.

The outer bag 12 can have a gusset-like shape by making the area of the heat-sealed portion 12*a* large in the bottom 12*e* of the outer bag 12. The outer bag 12 having a gusset-like shape can stand by itself in the metal can 2.

By allowing the outer bag 12 having a gusset-like shape to stand by itself in the metal can 2, the chemical storage bag 10 as a whole can be housed stably in the metal can 2. Thus, the chemical storage bag 10 will not swing nor become displaced in the metal can 2 during transport of the chemical storage container 1; therefore, the liquid chemical 3 in the inner bag 11 can be stably transported.

The operation of the chemical storage container 1 of this embodiment having the above-described construction will now be described.

A method for producing the chemical storage container 1 will be described first.

As shown in FIG. 4, the inner bag 11 is inserted from the top opening of the outer bag 12 into the outer bag 12 having a gusset-like shape and placed in it.

Next, the ejection member 15 is inserted from the top opening of the inner bag 11 into the inner bag 11.

Thereafter, the top opening of the inner bag 11 is aligned with the top opening of the outer bag 12, and they are heat-sealed integrally to form a sealed portion 13. At the same time, the seal fixing portion 25 of the ejection member 15 is heat-sealed integrally with the inner bag 11 and the outer bag 12, whereby the ejection member 15 is fixed by the sealed portion 13 to the inner bag 11 and the outer bag 12 (see FIG. 4).

The chemical storage bag 10, including the inner bag 11 and the outer bag 12 and to which the ejection member 15 is mounted, is obtained in this manner. On the other hand, the lid 5 to which the chemical nozzle 16, the pressurized gas supply nozzle 17 and the pressure gauge 18 have been mounted is prepared. The chemical nozzle 16 is inserted into the chemical nozzle space 15A formed by the partition wall 20 of the ejection member 15, and the chemical storage bag 10, the lid 5 and the ejection member 15 are assembled together.

Next, the chemical storage bag 10 is inserted from the top opening 2*a* into the metal can 2, and the ejection member 15 is fit into the top opening 2*a* of the metal can 2. In particular, the peripheral flange 21 of the ejection member 15 is fit into the top opening 2*a* of the metal can 2, and the lid 5 is fastened by bolts 6 to a portion of the metal can 2, located around the top opening 2*a*. The pressurized gas supply nozzle 17, mounted to the lid 5, extends in the pressurized gas space 15B of the ejection member 15.

When using the chemical storage container 1, the chemical nozzle 16 is connected via the connecter 16*a* to an external supply mechanism (not shown), and the liquid chemical 3 is supplied from the supply mechanism into the inner bag 11.

Next, after the connecter 16*a* of the chemical nozzle 16 is closed by a not-shown cap, the chemical storage container 1, including the metal can 2 and the chemical storage bag 10 composed of the inner bag 11 and the outer bag 12, is transported to a destination. The cap is detached from the connecter 16*a* of the chemical nozzle 16, and the connecter 16*a* is connected to a discharge mechanism (not shown).

Next, the connecter 17*a* of the pressurized gas supply nozzle 17 is connected to a gas supply mechanism (not shown), and $N_2$ gas is supplied from the pressurized gas supply nozzle 17 into the pressurized gas space 15B of the ejection member 15. The $N_2$ gas in the pressurized gas space 15B is fed through the through-hole 22*a* of the ejection member 15 into the pressurization space 8 between the metal can 2 and the chemical storage bag 10, where the $N_2$ gas externally pressurizes the chemical storage bag 10. The liquid chemical 3 in the inner bag 11 of the chemical storage bag 10 can therefore be discharged from the chemical nozzle 16 to the discharge mechanism. During the chemical discharge operation, the amount of $N_2$ gas supplied can be adjusted while monitoring the pressure of $N_2$ gas with the pressure gauge 18.

As described hereinabove, according to this embodiment, the chemical storage container 1 for storing a liquid chemical comprises: the metal can 2; the chemical storage bag 10 disposed in the metal can 2 and including the inner bag 11 for storing the liquid chemical 3, and the outer bag 12 that surrounds the inner bag 11; and the ejection member 15 mounted to the chemical storage bag 10. Compared to a device in which a liquid chemical 3 is directly put in a metal can 2, the chemical storage container 1 has the advantages of no need for frequent cleaning of the metal can 2, enabling a significant reduction in the cleaning cost.

Further, the chemical storage container 1 is provided with the lid 5 which covers the ejection member 15 and closes the top opening 2*a* of the metal can 2. The chemical nozzle 16, which is to penetrate through the ejection member 15, and the pressurized gas supply nozzle 17 are mounted to the lid 5 in advance of assembling the chemical storage container 1. When assembling the chemical storage container 1, the chemical nozzle 16 is inserted into the ejection member 15 which has been mounted to the chemical storage bag 10 in advance.

Thereafter, the lid 5 is fixed on the top opening 2*a* of the metal can 2. In this manner, the chemical nozzle 16 and the pressurized gas supply nozzle 17 can be installed easily in a simple manner.

It is possible that during transport of the chemical storage container 1, pressure may be applied from the liquid chemical 3 to the inner surface of the inner bag 11. According to this embodiment, the corner 11*b* of the inner surface of the inner bag 11 has a curved shape. Therefore, even when pressure is applied from the liquid chemical 3 to the inner surface of the inner bag 11, there will be no concentration of local stress in the corner 11*b*. Therefore, there will be no breakage of the inner bag 11 in the vicinity of the corner 11*b*.

The material 11A for the inner bag 11 has a low moisture content, a low halogen content and a low ion content. This can prevent the liquid chemical 3 stored in the inner bag 11 from being deteriorated or adversely affected by the inner bag 11.

Because of the gusset-like shape, the outer bag 12 can stably stand by itself in the can body 2A of the metal can 2. Therefore, the outer bag 12 will not swing nor become displaced in the metal can 2 during transport of the chemical storage container 1.

The material 12A for the outer bag 12 has excellent impact resistance and gas barrier properties. Therefore, the outer bag 12 can externally protect the inner bag 11 so that an impact on the metal can 2 will not be directly transmitted to the inner bag 11 and, in addition, can prevent intrusion of the external atmosphere into the liquid chemical 3 in the inner bag 11.

In the above-described embodiment, the ejection member 15 is provided with the cylindrical partition wall 20 which divides the interior of the ejection member 15 into the chemical nozzle space 15A and the pressurized gas space 15B. However, it is also possible to provide a cylindrical partition wall which extends from the lower surface of the lid 5 without providing the cylindrical partition wall 20 in the ejection member 15.

Variations

Variations of the chemical storage container according to the present disclosure will now be described with reference to FIG. 6 and FIGS. 7A through 7C.

The variations shown in FIG. 6 and FIGS. 7A through 7C differ from the above-described embodiment shown in FIGS. 1 through 5A, 5B in the construction of the chemical storage bag 10; the variations are substantially the same as the above-described embodiment in the other construction. For the variations shown in FIG. 6 and FIGS. 7A through 7C, the same reference numerals are used to refer to the same or like members or components, and a detailed description thereof is omitted.

Figure 6:
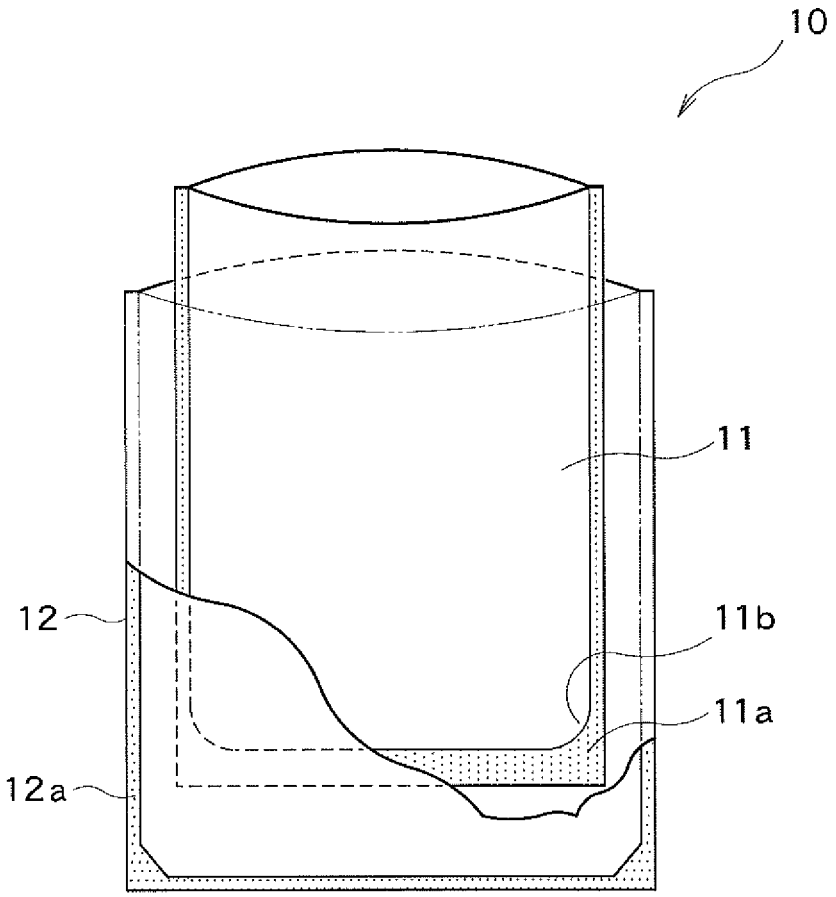
FIG. 6 is a diagram showing a variation of the chemical storage container in accordance with an embodiment.

Referring first to the variation shown in FIG. 6, the chemical storage bag 10 includes an inner bag 11 and an outer bag 12.

The ejection member 15 is omitted from FIG. 6 for clarity.

The chemical storage bag 10 of FIG. 6 includes the inner bag 11 for storing a liquid chemical 3 such as a lithium-ion battery electrolyte, and the outer bag 12 that surrounds the inner bag 11.

The outer bag 12 is obtained by folding a film composed of the material 12A for the outer bag 12, and heat-sealing opposing side peripheries to form a heat-sealed portion 12*a*. Thus, the outer bag 12 has a three-way seal structure.

The outer bag 12 having the three-way seal structure can achieve a reduction in the number of sealed portions. The outer bag 12 can therefore have an increased strength.

Another variation of the chemical storage container according to the present disclosure will now be described with reference to FIGS. 7A through 7C.

Figure 7A:
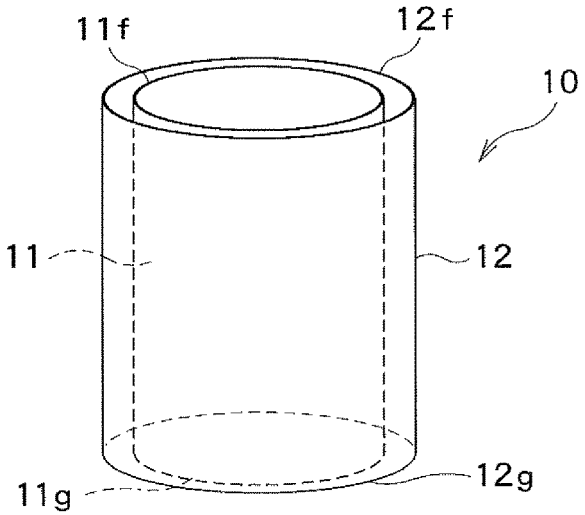
FIGS. 7A through 7C are diagrams showing another variation of the chemical storage container in accordance with an embodiment.
Figure 7B:
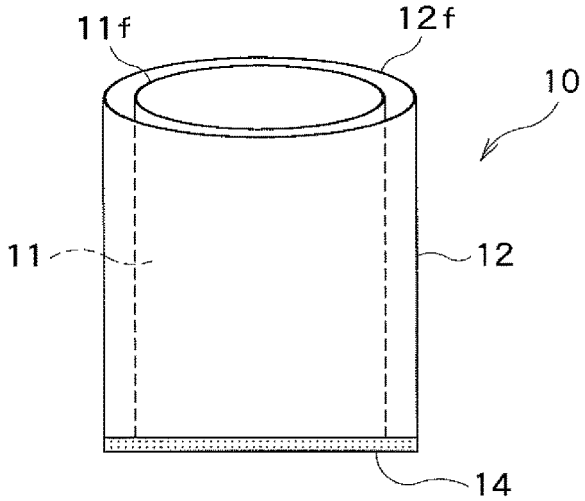
Figure 7C:
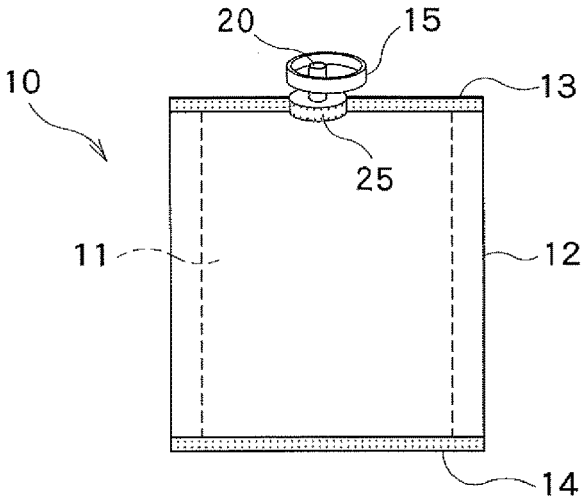

The chemical storage bag 10 shown in FIGS. 7A through 7C includes an inner bag 11 for storing a liquid chemical 3 such as a lithium-ion battery electrolyte, and an outer bag 12 that surrounds the inner bag 11, and is provided with an ejection member 15 that penetrates through the inner bag 11 and the outer bag 12.

The ejection member 15 is fixed to the inner bag 11 and the outer bag 12 at a seal fixing portion 25 which is heat-sealed with a sealed portion 13 where the inner bag 11 and the outer bag 12 are sealed integrally.

The inner bag 11 and the outer bag 12 are each comprised of a cylindrical polyethylene tube having no sealed portion and having a top opening 11*f*, 12*f* and a bottom opening 11*g*, 12*g*.

The chemical storage bag 10 including the inner bag 11 and the outer bag 12 can be produced in the following manner. First, the inner bag 11 comprised of a cylindrical tube is placed in the outer bag 12 (see FIG. 7A). Next, the bottom openings 11*g*, 12*g* of the inner bag 11 and the outer bag 12 are heat-sealed integrally to form a bottom sealed portion 14 (see FIG. 7B).

Next, the ejection member 15 is inserted from the top opening 11*f* into the inner bag 11.

Thereafter, the top opening 11*f* of the inner bag 11 is aligned with the top opening 12*f* of the outer bag 12, and they are heat-sealed integrally to form a sealed portion 13. At the same time, the seal fixing portion 25 of the ejection member 15 is heat-sealed integrally with the inner bag 11 and the outer bag 12, whereby the ejection member 15 is fixed by the sealed portion 13 to the inner bag 11 and the outer bag 12.

As described above, the inner bag 11 and the outer bag 12 are each comprised of a cylindrical tube. Therefore, the chemical storage bag 10 can be easily obtained by inserting the inner bag 11 into the outer bag 12, aligning the inner bag 11 with the outer bag 12, and heat-sealing the bottom openings 11*g*, 12*g* and the top opening 11*f*, 12*f*.

DESCRIPTION OF THE REFERENCE NUMERALS

1 chemical storage container 1
2 metal can
2*a* top opening
3 liquid chemical
5 lid
6 bolt
8 pressurization space
10 chemical storage bag
11 inner bag
11*a* heat-sealed portion
11*b* corner
12 outer bag
12*a* heat-sealed portion
13 sealed portion
15 ejection member
15A chemical nozzle space
15B pressurized gas space
16 chemical nozzle
17 pressurized gas supply nozzle
20 cylindrical partition wall
22 bottom
22*a* through-hole
25 seal fixing portion
26 coupling portion

The invention claimed is:

1. A chemical storage container for storing a liquid chemical, comprising:

an outer can having a top opening;

a chemical storage bag for storing a liquid chemical and configured to be disposed in the outer can;

an ejection member configured to be mounted to an upper end of the chemical storage bag; and a lid configured to close the top opening of the outer can and cover the ejection member, wherein the lid has a chemical nozzle for discharging the liquid chemical configured to penetrate through the ejection member and a pressurized gas supply nozzle for supplying a pressurized gas into the ejection member, wherein the lid has a planar shape and is configured to be fixed to a portion of the outer can, located around the top opening by fastening bolts, the ejection member has a bottom, a side extending from the periphery of the bottom, and a periphery flange which is configured to fit into the top opening of the outer can, and wherein the ejection member is provided with:

(i) a partition wall extending upward from the bottom and which is formed integrally with the ejection member and divides the interior of the ejection member into a chemical nozzle space on an inner side of the partition wall, through which the chemical nozzle penetrates, and a pressurized gas space on an outer side of the partition wall, which is to be filled with the pressurized gas, (ii) a coupling portion extending downwardly from the bottom and the partition wall, (iii) an enlarged seal fixing portion having an outer diameter larger than an outer diameter of the coupling portion, the enlarged seal fixing portion formed integrally with the coupling portion, and wherein each of the partition wall, the coupling portion and the enlarged seal fixing portion has a hole with the same inner diameter, the chemical nozzle penetrates through each of the holes of the partition wall, the coupling portion and the enlarged seal fixing portion, and (iv) the ejection member has a through-hole which is provided at the bottom, and configured to connect the pressurized gas spaced to a pressurization space formed between the outer can and the chemical storage bag.

2. The chemical storage container according to claim 1, wherein the peripheral flange is configured to be sandwiched between an upper surface of the outer can and a lower surface of the lid.

3. The chemical storage container according to claim 1, wherein the coupling portion is configured to extend toward the upper end of the chemical storage bag, the enlarged seal fixing portion has an elliptical shape in a plan view.

4. The chemical storage container according to claim 1, wherein the pressurization space is configured to be arranged around a circumference of the chemical storage bag.

5. The chemical storage container according to claim 1, wherein the pressurization space has a broader part forming a clearance between the ejection member and the upper end of the chemical storage bag, and a narrower part forming a clearance between the outer can and the chemical storage bag, the narrower part being narrower than the broader part.

6. The chemical storage container according to claim 5, wherein the clearance of the narrower part is uniform in an unpressurized state.

7. The chemical storage container according to claim 1, wherein the chemical storage bag includes an inner bag and an outer bag overlaying the inner bag.

8. The chemical storage container according to claim 7, wherein the inner bag has a curved corner at a lower end of the inner bag.

9. A method of discharging a liquid chemical comprising the steps of:

providing the chemical storage container for storing a liquid chemical according to claim 1;

supplying the pressurized gas into the pressurized gas space through the pressurized gas supply nozzle; and supplying the pressurized gas from the pressurized gas space to the pressurization space formed between the outer can and the chemical storage bag to thereby externally pressurize the chemical storage bag such that the liquid chemical is discharged from the chemical storage bag through the chemical nozzle.

10. The method of discharging a liquid chemical according to claim 9, further comprising a step of:

monitoring a pressure in the pressurized gas space.

* * * * *